US006275132B1

(12) United States Patent
Shikama et al.

(10) Patent No.: US 6,275,132 B1
(45) Date of Patent: Aug. 14, 2001

(54) INDUCTOR AND METHOD OF MANUFACTURING SAME

(75) Inventors: Takashi Shikama, Yokaichi; Masami Sugitani, Fukui-ken; Takahiro Yamamoto; Hisato Oshima, both of Yokaichi, all of (JP)

(73) Assignee: Murata Manufacturing Co., LTD, Kyoto (JP)

( * ) Notice: Subject to any disclaimer, the term of this patent is extended or adjusted under 35 U.S.C. 154(b) by 0 days.

(21) Appl. No.: 09/170,783

(22) Filed: Oct. 13, 1998

(30) Foreign Application Priority Data

Oct. 24, 1997 (JP) ..... 9-292602

(51) Int. Cl.[7] ..... H01F 27/02

(52) U.S. Cl. ..... 336/83; 336/200; 336/96; 29/602.1

(58) Field of Search ..... 336/200, 83, 232, 336/223, 65, 96; 29/602.1, 605–609; 257/531

(56) References Cited

U.S. PATENT DOCUMENTS 4,490,706 * 12/1984 Stou et al. ..... 336/96
4,801,912 * 1/1989 McElheny et al. ..... 336/84 R
5,307,557 * 5/1994 Te-Hsueh ..... 29/605
5,690,771 * 11/1997 Kato et al. ..... 156/244.11
6,055,721 * 5/2000 Mamada et al. ..... 29/605

FOREIGN PATENT DOCUMENTS 57-92807 * 6/1982 (JP) .
3-196605 * 8/1991 (JP) .
8-306570 * 11/1996 (JP) .

* cited by examiner

*Primary Examiner*—Lincoln Donovan
*Assistant Examiner*—Tuyen T. Nguyen
(74) *Attorney, Agent, or Firm*—Keating & Bennett, LLP

(57) ABSTRACT

An inductor includes a coiled metal wire, an insulating molded member in which the coiled metal wire is embedded, and metal caps fitted on both ends of the insulating molded member. The metal caps are welded to both ends of the coiled metal wire. Between the metal caps and the end surfaces of the insulating molded member, spaces are defined respectively. The insulating molded member is made of, for example, resin or rubber.

18 Claims, 2 Drawing Sheets

INDUCTOR AND METHOD OF MANUFACTURING SAME

BACKGROUND OF THE INVENTION

1. Field of the Invention

The present invention relates to an inductor, and more particularly, to a high-current inductor for removing noise that originates in electronic equipment or noise that enters electronic equipment, and a method of manufacturing such an inductor.

2. Description of the Related Art

With recent miniaturization and increases in the level of integration and in the frequency of circuits, there has been an increasing demand for miniature surface-mount inductors.

An example of this type of inductor is a multilayer inductor disclosed in Japanese Examined Patent Publication No. 57-39521. This multilayer inductor is manufactured by alternately stacking green sheets of ferrite and conductive patterns for forming a coil, baking them together, and making a multilayer unit that incorporates a coil composed of the coil conductive patterns electrically connected in series.

A conventional wire-wound inductor may also be manufactured by forming electrodes on a substrate for holding a magnetic core, winding a conductive wire on the magnetic core, and connecting terminals of the conductive wire to the electrodes on the substrate.

In the conventional methods of manufacturing the multilayer inductor, however, it is necessary to repeat a printing step many times, the manufacturing process is complicated and the manufacturing cost is high. Although the wire-wound inductor has a relatively simple structure, it is difficult to automate the operations of winding the conductive wire on the magnetic core, processing the terminals of the conductive wire, and soldering the processed terminals of the conductive wire to the electrodes on the substrate for holding the magnetic core. Therefore, these operations are manually performed which increases the manufacturing cost of the wire wound inductor.

SUMMARY OF THE INVENTION

To overcome the problems described above, preferred embodiments of the present invention provide an inductor with a simple structure which provides high reliability, high mass productivity, and low manufacturing cost, and a method of manufacturing such an improved inductor.

According to a preferred embodiment of the present invention, an inductor includes an insulating molded member having magnetic powders mixed therein, a coiled metal wire embedded in the insulating molded member, and metal caps respectively fitted on both ends of the insulating molded member and electrically connected to both ends of the coiled metal wire, wherein spaces are formed between the end surfaces of the insulating molded member and the metal caps. Preferably, the insulating molded member is made of resin, rubber material or the like.

According to the structure of the preferred embodiment described above, the metal caps function as outer terminals, the magnetic powders mixed in the insulating molded member increase the permeance of the insulating molded member, and the insulating molded member functions as a magnetic path for a magnetic flux generated around the coiled metal wire. Since the spaces between the end surfaces of the insulating molded member and the metal caps absorb the difference in thermal expansion between the insulating molded member and the coiled metal wire, it is possible to reduce the thermal stress that is applied to the connecting portions between the metal caps and the coiled metal wire.

Another preferred embodiment of the present invention provides a method of manufacturing an inductor, the method including the steps of forming an insulating molded member by putting a coiled metal wire in a mold and pouring into the mold an insulating material having magnetic powders mixed therein, fitting metal caps on both ends of the insulating molded member and putting the metal caps into contact with both ends of the coiled metal wire and welding the metal caps to both ends of the coiled metal wire and forming spaces between both end surfaces of the insulating molded member and the surfaces of the metal caps by using heat generated during welding.

According to the preferred embodiment of the method described above, the metal caps are electrically connected to both ends of the coiled metal wire, respectively, and both ends of the insulating molded member are caused by the heat produced during welding to melt, to contract, and to retreat from the metal cap surfaces, whereby spaces are easily formed between the metal caps and the end surfaces of the insulating molded member, respectively.

Further, the inductor of preferred embodiments of the present invention has spaces which are provided between the metal caps and the insulating molded member such that the difference of thermal expansion between the insulating molded member and the metal caps is absorbed.

In another preferred embodiment of the present invention, the inductor has spaces which are formed between the metal caps and the insulating molded member such that heat generated during welding melts and contracts the insulating molded member and the end surfaces of the insulating molded member retreat from the metal caps.

In another preferred embodiment of the present invention, both ends of the coiled metal wire project from the end surfaces of the insulating molded member.

Further objects, features and advantages of the present invention will become apparent from the following description of preferred embodiments with reference to the attached drawings.

DETAILED DESCRIPTION OF PREFERRED EMBODIMENTS

An inductor and a method of manufacturing the inductor according to preferred embodiments of the present invention will be described below with reference to the attached drawings.

Figure 1:
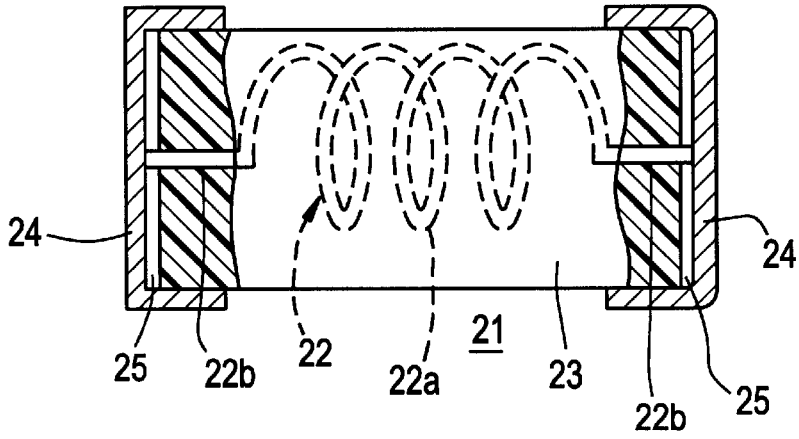
FIG. 1 is a partially cutaway front view showing the structure of an inductor according to a preferred embodiment of the present invention.

FIG. 1 shows an inductor according to a preferred embodiment of the present invention. The inductor 21 includes a coiled metal wire 22, an insulating molded member 23 in which the coiled metal wire 22 is embedded, and metal caps 24 fitted on both ends of the insulating molded member 23.

The coiled metal wire 22 is composed of a coil portion 22*a* wound in a helical shape, and linear lead-out portions 22*b* at both ends of the coil portion 22*a*.The coiled metal wire 22 is made of, for example, a metal or an alloy containing one or more of Ag, Pd, Pt, Au, and Cu.

The insulating molded member 23 is preferably shaped like a substantially rectangular parallelepiped that is substantially rectangular in transverse section. On both end surfaces of the insulating molded member 23, end surfaces of the lead-out portions 22*b* of the coiled metal wire 22 are exposed, respectively. The insulating molded member 23 is made of, for example, a material in which magnetic powders of ferrite or the like are mixed in a resin (a synthetic resin such as epoxy) or a rubber (a synthetic rubber such as silicon) having a high heat resistance to the soldering temperature and to the reflow temperature experienced during mounting of the inductor 21 on a printed circuit board.

The metal caps 24 are preferably molded into the shape of a cap such that the caps 24 are fitted on both ends of the insulating molded member 23, and are electrically connected to both ends of the coiled metal wire 22, respectively, by welding or other suitable joining process. The ends of the metal caps 24 are preferably tapered before fitting so as to secure the metal caps 24 to the insulating molded member 23. The metal caps 24 are preferably made of, for example, a metal or an alloy containing one or more of Fe, Cu, Ni, and Ag. Spaces 25 are formed between the metal caps 24 and the end surfaces of the insulating molded member 23, respectively.

In this surface-mount inductor 21, the metal caps 24 are respectively fitted on both ends of the insulating molded member 23 having the coiled metal wire 22 embedded therein, and are electrically connected to both ends of the coiled metal wire 22. Therefore, the structure is extremely simple and the number of components is reduced. Since the spaces 25 between the metal caps 24 and the end surfaces of the insulating molded member 23 absorb the difference in thermal expansion between the insulating molded member 23 and the coiled metal wire 22, even when the insulating molded member 23 expands, thermal stress is not applied to the welded portions between the metal caps 24 and the coiled metal wire 22. This significantly improves the reliability of the electric connection between the metal caps 24 and the coiled metal wire 22.

An example of a method of manufacturing the inductor 21 having the structure shown in FIG. 1 will now be described specifically with reference to FIGS. 2 to 5.

Figure 2:
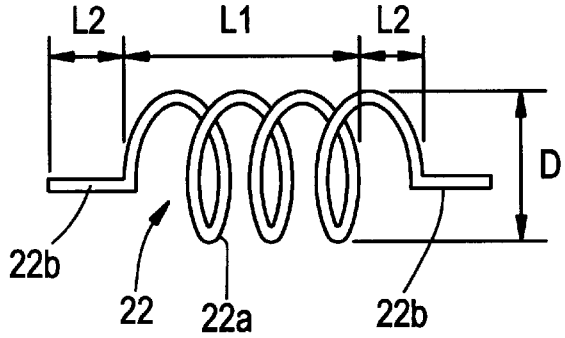
FIG. 2 is a front view of a coiled metal wire, showing a step of manufacturing the inductor shown in FIG. 1.

First, as shown in FIG. 2, a coiled metal wire 22 is formed by winding an Ag wire having a wire diameter of about 200 μm. A coil portion 22*a* of the coiled metal wire 22 preferably has a diameter D of about 1.5 mm and a length L1 of about 2.5 mm, and lead-out portions 22*b* thereof have a length L2 of about 0.75 mm.

Next, the coiled metal wire 22 is placed in a mold (not shown) made of polystyrene to mold an insulating molded member 23 so that a coil axis thereof almost aligns with the axis of the mold. In this case, if the mold has a positioning hole through which the lead-out portions 22*b* of the coiled metal wire 22 are inserted, it is possible to easily position the coiled metal wire 22 inside the mold.

Figure 3:
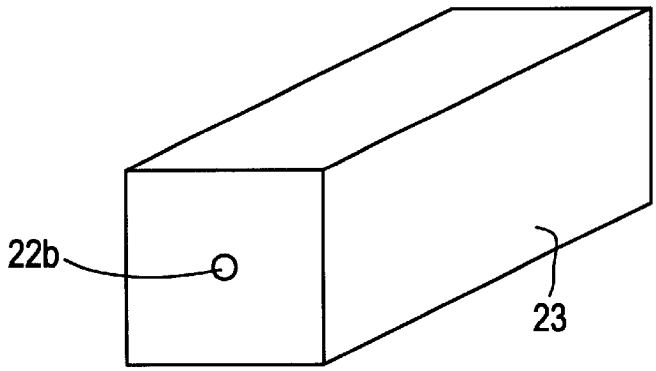
FIG. 3 is a perspective view of an insulating molded member in which the coiled metal wire is embedded, showing a manufacturing step performed after the step shown in FIG. 2.

Poured into the mold having the coiled metal wire 22 placed therein is a slurry including a synthetic resin mainly containing polyethylene terephthalate, a dispersant, and a Ni—Cu—Zn ferrite that are kneaded at a volume ratio of 35:5:60. When the mold is removed after the slurry has hardened, the insulating molded member 23 shaped like a substantially rectangular block is obtained as shown in FIG. 3. In this preferred embodiment, the insulating molded member 23 is preferably about 4.5 mm in length, about 2.5 mm in width, and about 2.5 mm in height.

Figure 4:
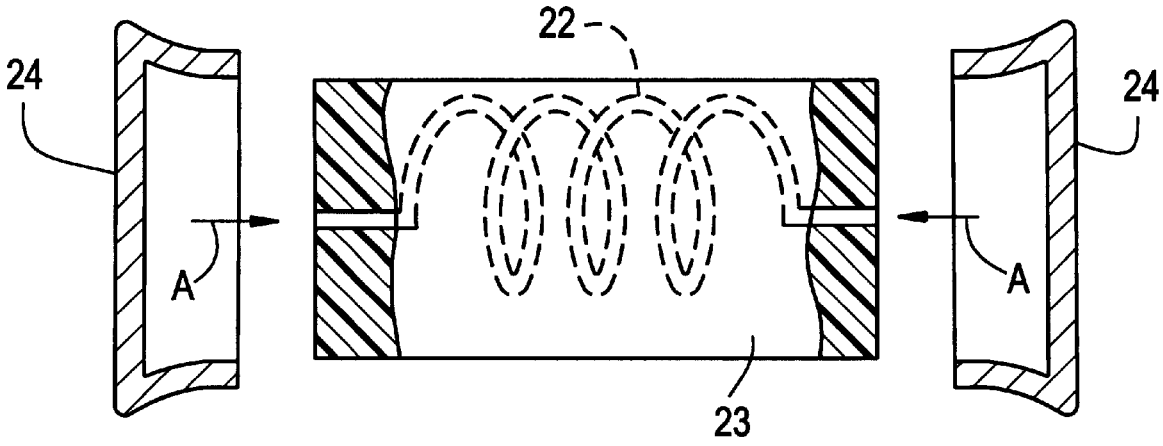
FIG. 4 is an explanatory view showing a step of fitting metal caps on the insulating molded member shown in FIG. 3.
Figure 5:
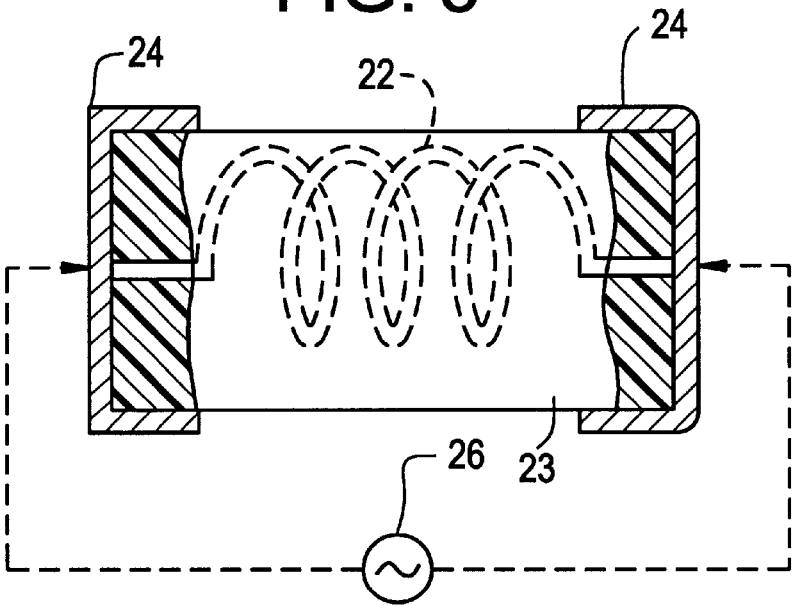
FIG. 5 is an explanatory view showing a step of welding the coiled metal wire and the metal caps.

After that, metal caps 24 preferably formed of a Cu thin plate shaped like a cap are fitted on both ends of the insulating molded member 23 so that caps 24 are in contact with both ends of the coiled metal wire 22, as shown by the arrows A in FIG. 4. In this case, the dimensions of the metal caps 24 are much smaller than those of the ends of the insulating molded member 23, and the elasticity of the insulating molded member 23 is utilized to improve the ability of the metal caps 24 to fit on the insulating molded member 23. In this state, a power supply 26 is connected to the metal caps 24, and current is applied to the coiled metal wire 22, as shown in FIG. 5. Thereby, the contact portions between the coiled metal wire 22 and the metal caps 24 are caused by Joule's heat to generate heat and melt, so that the metal caps 24 are joined and welded to both ends of the coiled metal wire 22. Both ends of the insulating molded member 23 also melt because of this heat applied during welding. As a result of the melting, both ends of the insulating molded member 23 contract and retreat from the surfaces of the metal caps 24, for example, by about 200 μm, whereby spaces 25 are formed between the metal caps 24 and both end surfaces of the insulating molded member 23, respectively.

Next, the metal caps 24 are preferably metal-plated as needed in order to improve solderability and oxidation resistance, and an inductor 21 having the structure described in connection with FIG. 1 is obtained.

Through these processes, the insulating molded member 23 having the coiled metal wire 22 embedded therein can be easily and efficiently formed by using a mold. By applying current to the metal caps 24 from the power supply 26 connected thereto, the contact portions between the coiled metal wire 22 and the metal caps 24 are caused by Joule's heat to generate heat and melt, and the metal caps 24 are welded to both ends of the coiled metal wire 22. Both ends of the insulating molded member 23 also melt and contract, whereby spaces 25 are formed between the metal caps 24 and the end surfaces of the insulating molded member 23. This makes it possible to manufacture the inductor 21 with great efficiency.

While the present invention has been described with reference to what is presently considered to be preferred embodiments thereof, it is to be understood that the invention is not limited to the disclosed preferred embodiments. On the contrary, the invention is intended to cover various modifications and equivalent arrangements included within the spirit and scope of the invention.

For example, the insulating molded member may be substantially circular or the like in transverse cross section instead of being substantially rectangular. Furthermore, the insulating molded member may be made of an organic material so that it is burned off because of the Joule's heat applied during welding to form spaces between the metal caps and both end surfaces of the insulating molded member. The metal caps may be welded to the coiled metal wire after being metal-plated.

As mentioned above, according to preferred embodiments of the present invention, the coiled metal wire is embedded in the insulating molded member, and the metal caps defining electrodes are fitted on both ends of the insulating molded member so that the metal caps are electrically connected to the ends of the coiled metal wire. Therefore, it is possible to obtain a surface-mount inductor having a simple structure and a high mass productivity and including a small number of components. Moreover, since the spaces formed between the metal caps and the end surfaces of the insulating molded member absorb the difference in thermal expansion between the insulating molded member and the coiled metal wire, the thermal stress to be applied to the welded portions between the metal caps and the coiled metal wire is reduced, and a reliable inductor can be provided at a low cost.

Furthermore, according to preferred embodiments of the present invention, since the insulating molded member is formed with a mold in the step of embedding the coiled metal wire in the insulating molded member, the inductor achieves given a high accuracy of dimension and a small size, which can easily increase in level of integration. Moreover, since the metal caps are electrically connected to both ends of the coiled metal wire by welding, the heat produced in welding causes the end surfaces of the insulating molded member to melt, contract, and retreat from the metal cap surfaces, thereby forming spaces between the metal caps and the end surfaces of the insulating molded member. This makes it possible to easily and efficiently manufacture an inductor.

What is claimed is:

1. An inductor, comprising:

an insulating molded member having magnetic powders disposed therein;

a coiled metal wire embedded in said insulating molded member; and metal caps fitted on both ends of said insulating molded member;

wherein said metal caps are electrically connected to both ends of said coiled metal wire and spaces are provided between end surfaces of said insulating molded member and said metal caps such that said metal caps are not in contact with said end surfaces of said insulating molded member.

2. An inductor according to claim 1, wherein said insulating molded member is made of at least a resin material or a rubber material.

3. An inductor according to claim 1, wherein said spaces are provided between said metal caps and said insulating molded member such that a difference of thermal expansion between said insulating molded member and said metal caps is absorbed by said spaces.

4. An inductor according to claim 1, wherein said spaces are formed between said metal caps and said insulating molded member by heat generated by welding operation to be performed on said inductor which melts and contracts said insulating molded member and said end surfaces of said insulating molded member retreat from said metal caps.

5. An inductor according to claim 1, wherein both ends of said coiled metal wire are projected from the end surfaces of said insulating molded member.

6. An inductor according to claim 1, wherein each of said metal caps includes upper and lower segments and a side segment interconnecting said upper and lower segments.

7. An inductor according to claim 6, wherein said upper and lower segments of each of said metal caps are disposed in contact with said insulated molded member and said side segment of each of said metal caps is spaced from said insulated molded member.

8. An inductor according to claim 7, wherein both ends of said coiled metal wire are projected from a respective one of the end surfaces of said insulated member and are electrically and physically connected to said side segment of a respective one of said end caps.

9. An inductor, comprising:

an insulating molded member;

a coiled metal wire embedded in said insulating molded member; and metal electrodes disposed on opposite end surfaces of said insulating molded member;

wherein said metal electrodes are electrically connected to both ends of said coiled metal wire and said opposite end surfaces of said insulating molded member are spaced from said metal electrodes such that said metal electrodes are not in contact with said opposite end surfaces of said insulating molded member.

10. An inductor according to claim 9, wherein said insulating molded member includes magnetic powders mixed therein.

11. An inductor according to claim 9, wherein said metal electrodes comprise metal caps.

12. An inductor according to claim 9, wherein said insulating molded member is made of at least a resin material or a rubber material.

13. An inductor according to claim 9, wherein spaces are provided between said metal electrodes and said insulating molded member such that a difference of thermal expansion between said insulating molded member and said metal electrodes is absorbed by said spaces.

14. An inductor according to claim 9, wherein said spaces are formed between said metal electrodes and said insulating molded member by heat generated by a welding operation to be performed on said inductor which melts and contracts said insulating molded member and said opposite end surfaces of said insulating molded member retreat from said metal electrodes.

15. An inductor according to claim 9, wherein both ends of said coiled metal wire are projected from the opposite end surfaces of said insulating molded member.

16. An inductor according to claim 9, wherein each of said metal electrodes includes upper and lower segments and a side segment interconnecting said upper and lower segments.

17. An inductor according to claim 16, wherein said upper and lower segments of each of said metal electrodes are disposed in contact with said insulated molded member and said side segment of each of said metal electrodes is spaced from said insulated molded member.

18. An inductor according to claim 17, wherein both ends of said coiled metal wire are projected from a respective one of the end surfaces of said insulated member and are electrically and physically connected to said side segment of a respective one of said metal terminals.

* * * * *